US010683182B2

(12) United States Patent
Downing et al.

(10) Patent No.: US 10,683,182 B2
(45) Date of Patent: Jun. 16, 2020

(54) PAGE REGISTRATION SYSTEM

(71) Applicant: Hewlett-Packard Development Company, L.P., Houston, TX (US)

(72) Inventors: Elliott Downing, Vancouver, WA (US); Steve O Rasmussen, Vancouver, WA (US); Al Olson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 68 days.

(21) Appl. No.: 15/759,921

(22) PCT Filed: Dec. 9, 2015

(86) PCT No.: PCT/US2015/064682
§ 371 (c)(1),
(2) Date: Mar. 14, 2018

(87) PCT Pub. No.: WO2017/099748
PCT Pub. Date: Jun. 15, 2017

(65) Prior Publication Data

US 2018/0250961 A1 Sep. 6, 2018

(51) Int. Cl.
*B65H 7/10* (2006.01)
*B41J 13/10* (2006.01)
(Continued)

(52) U.S. Cl.
CPC ..... *B65H 7/10* (2013.01); *B41J 13/0036* (2013.01); *B41J 13/106* (2013.01); *B41J 13/26* (2013.01); *B41J 29/393* (2013.01); *B65H 9/10* (2013.01); *B65H 31/02* (2013.01); *B65H 31/20* (2013.01); *B65H 31/3063* (2013.01); *B65H 31/36* (2013.01); *B65H 35/0073* (2013.01); *B65H 43/00* (2013.01); *B65H 43/08* (2013.01); *B65H 2301/3613* (2013.01); *B65H 2301/4212* (2013.01); *B65H 2405/1116* (2013.01); *B65H 2511/12* (2013.01); *B65H 2511/20* (2013.01);
(Continued)

(58) Field of Classification Search
CPC ... B65H 7/06; B65H 7/10; B65H 7/20; B65H 9/10; B65H 9/101; B65H 43/04; B65H 43/08; B65H 2301/3613; B65H 2404/732; B65H 2511/242; B65H 2553/81; B65H 2553/822; B65H 2557/61; B65H 2701/1315; B65H 2405/114
See application file for complete search history.

(56) References Cited

U.S. PATENT DOCUMENTS 4,657,239 A * 4/1987 Ikesue ..... B65H 9/101 271/227
5,091,754 A * 2/1992 Abe ..... G03G 15/234 271/188
5,715,514 A * 2/1998 Williams ..... B65H 9/002 271/228
6,019,365 A * 2/2000 Matsumura ..... B65H 7/10 271/227
(Continued)

*Primary Examiner* — Prasad V Gokhale
(74) *Attorney, Agent, or Firm* — Fabian VanCott

(57) ABSTRACT

A page registration system may include, in an example, a media edge sensor to detect a location of an edge of a print media along a media feed path and in a direction non-parallel to the media feed path and a calibration sensor downstream of the media edge sensor to detect changes in the location of the edge of the print media in the direction non-parallel to the media feed path, and provide calibration data to the page registration system to correct changes in the location of the edge of the print media in the direction non-parallel to the media feed path.

14 Claims, 8 Drawing Sheets

(51) Int. Cl.

| | |
|---|---|
| ***B41J 29/393*** | (2006.01) |
| ***B65H 43/08*** | (2006.01) |
| ***B65H 31/02*** | (2006.01) |
| ***B65H 31/36*** | (2006.01) |
| ***B65H 31/20*** | (2006.01) |
| ***B65H 31/30*** | (2006.01) |
| ***B65H 9/10*** | (2006.01) |
| ***B41J 13/26*** | (2006.01) |
| ***B41J 13/00*** | (2006.01) |
| ***B65H 35/00*** | (2006.01) |
| ***B65H 43/00*** | (2006.01) |

(52) U.S. Cl.

CPC .. *B65H 2511/242* (2013.01); *B65H 2553/414* (2013.01); *B65H 2553/81* (2013.01); *B65H 2557/61* (2013.01); *B65H 2701/1315* (2013.01); *B65H 2801/06* (2013.01); *B65H 2801/27* (2013.01)

(56) References Cited

U.S. PATENT DOCUMENTS

| | | | | |
|---|---|---|---|---|
| 6,819,906 | B1 | 11/2004 | Herrmann et al. | |
| 7,207,559 | B2 | 4/2007 | Mizuta et al. | |
| 7,841,589 | B2 | 11/2010 | Kawata | |
| 8,038,147 | B2 | 10/2011 | Ogata et al. | |
| 8,109,505 | B2 * | 2/2012 | Shih | B65H 31/20 271/221 |
| 8,146,909 | B2 | 4/2012 | Kuno | |
| 8,246,034 | B2 * | 8/2012 | Tsuchiya | B42B 4/00 270/58.07 |
| 8,360,421 | B2 | 1/2013 | Tsuji et al. | |
| 8,540,229 | B2 | 9/2013 | Tsuji | |
| 8,695,971 | B2 | 4/2014 | Sekiyama et al. | |
| 2003/0141652 | A1 | 7/2003 | Guddanti et al. | |
| 2011/0049793 | A1 | 3/2011 | Dejong et al. | |
| 2011/0133396 | A1 | 6/2011 | Dondiego et al. | |
| 2013/0300055 | A1 * | 11/2013 | Ishikawa | B65H 9/00 271/227 |
| 2015/0356382 | A1 * | 12/2015 | Yamazaki | H04N 1/00 358/1.12 |

* cited by examiner

PAGE REGISTRATION SYSTEM

BACKGROUND

Printing devices may include an output tray or finisher where sheets of print media are accumulated. Often, additional finishing processes may be conducted on an accumulated stack of print media within the finisher including stapling and hole punching. These finishing operations use precisely aligned accumulated pages to meet user expectation.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
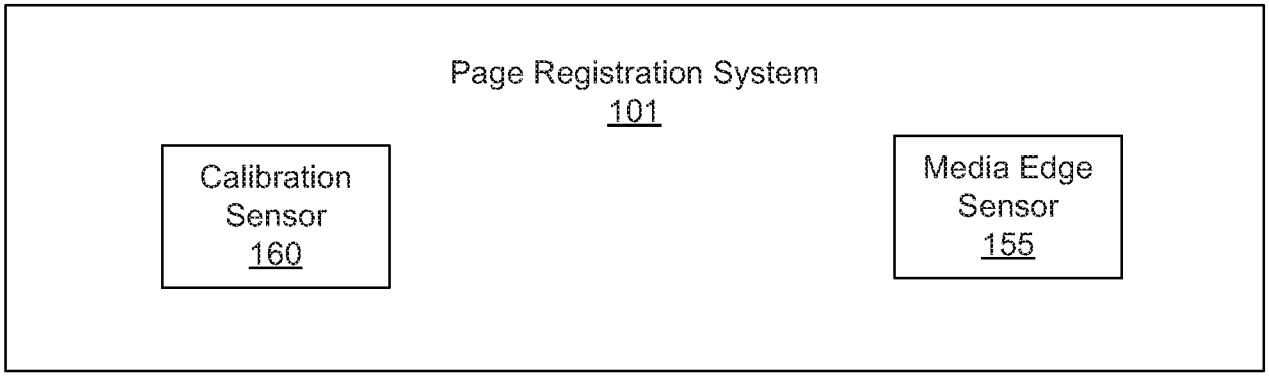
FIG. 1A is a block diagram of a page registration system according to an example of the principles described herein.

As mentioned above, printing devices may include a number of output trays where print media is allowed to accumulate. In some examples, the accumulation of the print media is done so that later finishing processes such as stapling and hole punching may be conducted on the entire stack of accumulated print media.

In preparation for these finishing processes, the individual sheets of print media are stacked and aligned. The alignment is done such that, in an example, the entire stack of print media may be stapled together so that the stapled final product is presented to an end user looking professionally assembled. Where the sheets of print media are to have holes punched through them, any misalignment of the sheets may result in a poorly looking product as well as a poorly functioning product. Misalignment of these sheets in this example may prevent the stack from being assembled into, for example, a binder.

In inkjet printing devices, alignment of the individual sheets of print media may be difficult to achieve. This may be especially so immediately after the printed sheets of print media have exited the printing device and have begun to accumulate in the output tray. Print fluid from the inkjets may not have dried sufficiently to provide a relatively friction-free surface between the accumulated sheets of print media. In this case, any accumulated sheets of print media would not align properly due to the sheets not being able to be pushed into alignment using, for example, tapper bars. Page curl may also result when print fluid has been soaked into the fibers of the print media. Additional curl may prevent alignment of the individual sheets. Still further, reduced page stiffness due to the print fluid soaking into the printed media may further cause misalignment of the sheets of print media should the print media be allowed to simply accumulate in the tray with or without alignment tapper bars.

The present specification describes a page registration system that accommodates for misalignment of sheets of media. The system comprises a plurality of print media edge sensors that detect an edge of each sheet of print media in a direction non-parallel to the media feed path as the print media exists the printing device and enters, in an example, an output tray. One of the media edge sensors may detect the edge of each sheet of media as each of these sheets passes along a media feed path. A second of these media edge sensors may be used to detect the edge of each sheet of media downstream of the media feed path from the first edge sensor. The second edge sensor may detect any changes in the location of the edge of the print media in the direction non-parallel to the media feed path of the print media. The second media edge sensor may then compare those changes to the detected location of the media edge by the first media edge sensor.

The present specification also describes a page registration system including, in an example, a media edge sensor to detect a location of an edge of a print media along a media feed path and in a direction non-parallel to the media feed path and a calibration sensor downstream of the media edge sensor correlate the edge of the print media in the direction non-parallel to the media feed path at the registration location, and provide calibration data to the page registration system to correct changes in the location of the edge of the print media in the direction non-parallel to the media feed path.

The present specification further describes a method for registering print media in a page registration system including, in an example, detecting a location of an edge of the print media in a direction non-parallel to a media feed path with a media edge sensor as the print media passes along the media feed path, detecting changes in the location of the edge of the print media in the direction non-parallel to the media feed path downstream of the media edge sensor, and adjusting the location of the edge of the print media with an x-registration servomechanism.

The present specification further describes a media output system including, in an example, a plurality of media support members to receive a number of sheets of print media, a page registration system comprising a calibration sensor to detect the position of an edge of at least one sheet of print media in a direction non-parallel to the media feed path and detect the position of a number of registration walls running parallel to the direction of the media feed path, and a registration servomechanism to receive adjustment data from a controller to adjust the position of the edge of the at least one sheet of print media as the media is positioned at least one of the plurality of media support members As used in the present specification and in the appended claims, the term "non-parallel" is meant to be understood as any direction that is not parallel to another direction. For example, a non-parallel direction relative a media feed path is a direction that intersects the direction of the media feed path.

Additionally, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. The apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1*a* is a block diagram of a page registration system (101) according to an example of the principles described herein. The page registration system (101) may include a media edge sensor (155) and a calibration sensor (160) to detect a location of an edge of a print media along a media feed path and in a direction non-parallel to the media feed path, detect the location of the edge of the print media in the direction non-parallel to the media feed path at a registration position; and provide calibration data to the page registration system to correct changes in the location of the edge of the print media in the direction non-parallel to the media feed path. The media edge sensor (155) and a calibration sensor (160) will be described in more detail below.

Figure 1B:
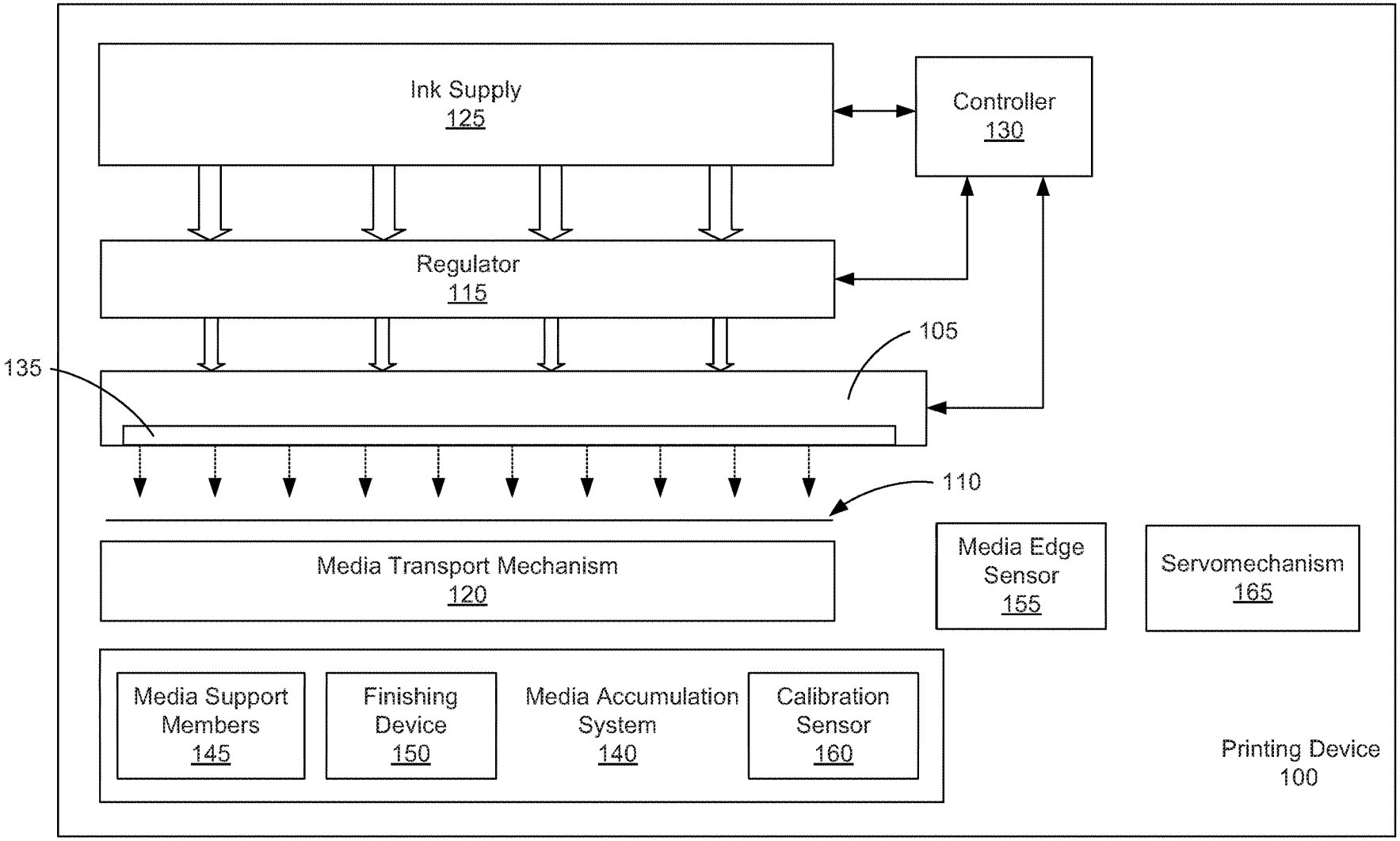
FIG. 1B is a block diagram of a printing device according to an example of the principles described herein.

FIG. 1B is a block diagram of a printing device (100) that, in an example, incorporates the page registration system (101) according to an example of the principles described herein. The printing device (100) may be any type of device that reproduces an image onto a sheet of print media. In an example, the printing device (100) may be an inkjet printing device, laser printing device, a toner-based printing device, a solid printing fluid printing device, a dye-sublimation printing device, among others. Although the present printing device (100) is described herein as an inkjet printing device, any type of printing device may be used in connection with the described systems, devices, and methods described herein. Consequently, an inkjet printing device (100) as described in connection with the present specification is meant to be understood as an example and is not meant to be limiting.

The printing device (100) may include a print bar (105), a printing fluid supply, (125), an printing fluid supply regulator (115), a media transport mechanism (120), a media accumulation system (140), and a controller (130). The printing fluid supply (125) may provide printing fluid or another type of ejectable fluid to the printing fluid supply regulator (115). The printing fluid supply regulator (115) may regulate an amount of printing fluid or other ejectable fluid provided to the print bar (105).

The print bar (105) may include a number of printheads (135) that receive the supply of ejectable fluid and eject the ejectable fluid onto a sheet of print media (110). In the example where the printing device (100) is an inkjet printing device, the ejectable fluid may penetrate the fibers of the print media (110) thereby producing an image on the print media (110). As mentioned above, un-dried or partially dried ejectable fluid on the print media (110) causes the print media (110) to be distorted from curl or cockle, reduces the stiffness of the print media (110), and increases the surface roughness on the print media (110) causing an increase in the coefficient of friction of the print media. These changes to the physical properties of the print media (110) prevents any given sheet of print media (110) from being stacked or accumulated together such that each sheet is aligned with the others in an x- and y-direction. The media transport mechanism (120) may physically place these sheets in position to be accumulated, but there may not be a way to maintain a position of any given sheet once it is released from the media transport mechanism (120). Still further, in some examples, the media transport mechanism (120) may not place each and every printed sheet of print media (110) in the same location every instance and may have a variable degree of accuracy.

As will be described in more detail below, the media accumulation system (140) of the present specification receives the printed print media (110) via the media transport mechanism (120). The media accumulation system (140) receives the print media onto a plurality of media support members (145) on a mezzanine level within the media accumulation system (140). The mezzanine level may be intermediate to a media transport level including the media transport mechanism (120) and an output level including a floor of the media accumulation system (140). In an example, one of the media support members (145) includes a number of reference walls running parallel to the direction of the media feed path. Each sheet of print media (110) is registered or placed against these number of reference walls.

The media accumulation system (140) may further include a number of finishing devices (150) to perform a number of finishing procedures on a stacked number of sheets of print media (110). These finishing procedures may include stapling, hole punching, embossing, binding, among others, or combinations thereof. Other types of finishing procedures may be conducted using a myriad of number of other types finishing devices (150) and the present specification contemplates the use of these other types of finishing devices (150).

The printing device (100) may further include a controller (130) to control each of the other devices associated with the printing device (100). In an example, the controller (130) may receive from, for example, a networked computing device, instructions to print and characteristics regarding a print job including the images to be printed on the print media (110) and the size and type of print media (110) to be printed. These instructions may be used by the controller (130) to direct the printing of a sheet of print media (110), the transportation of the print media (110), the accumulation of the print media (110) on the plurality of media support members (145), and the initiation of the finishing procedures described above.

As will be discussed in more detail below, the controller (130) may receive data from a number of print media edge sensors (155, 160) as well as a servomechanism (165) used to correct the placement of the print media (110) on the media support members (145). In an example, the sensors (155, 160) may include a media edge sensor (155) placed in the media feed path upstream from the output tray (140). This media edge sensor (155) may detect an edge of the print media that is to be registered against a registration wall; the registration wall running parallel to the direction the print media is entering the output tray (140). The media edge sensor (155) may travel in a direction non parallel to the direction of the media feed path in order to detect this edge. Placing the media edge sensor (155) along the media feed path, the position of the edge of the print media allows for a simultaneous restraining of the media that would otherwise curl in the accumulation area and would be relatively more difficult to measure if placed elsewhere. In one example, the media edge sensor (155) may comprise a reflective sensor that emits a light onto the surface of a mirror (303) and detects the reflection of that light. In this example, when the sensor does not receive a reflection back from the mirror (303), the sheet of print media (110) has blocked the refection and the edge of the sheet of print media (110) has been detected.

The calibration sensor (160) mitigates some of the variability described above by enabling a correlation between the x-positions detected of the sheets of print media (110) in the media feed path with the positions near a final registration point downstream.

In an example, a calibration sensor (160) may be placed downstream of the media edge sensor (155). The calibration sensor (160) detects the edge of the print media (110) that is to be registered against the registration wall as well as the position of the registration wall. The calibration sensor (160) may be placed in the output tray (140) next to where the print media is to be accumulated. A servomechanism (165) may be directed to shift the print media (110) in a direction non-parallel to the media feed path until the calibration sensor (160) detects the edge of the print media (110) that is to be registered against a registration wall. Once the calibration sensor (160) detects this edge, all data may be sent to the controller (130) for analysis. The data includes edge position data from the media edge sensor (155), edge detection data from the calibration sensor (160), and distance data from the servomechanism (165) describing a distance traveled in a direction non-parallel to the media feed path.

During a calibration procedure of the printing device (100), the edge position data and distance data is received by the controller (130) from the media edge sensor (155) and the servomechanism (165). The edge position data describes the initial position of the edge of the print media (110) and the distance data describes the direction and distance the servomechanism (165) had to travel in order for the calibration sensor (160) to detect the edge of the print media (110) to be registered against the registration wall. In an example, the initial position of the edge of the print media (110) is augmented by the distance the servomechanism (165) had to travel in order for the calibration sensor (160) to detect the edge of the print media and a calibration value is determined. Here the servomechanism (165) may have traveled in either a positive or negative direction and distance non-parallel to the direction of the media feed path. Consequently, the initial position of the edge of the print media (110) may have a value added to or subtracted from the initial position in order for the controller (130) to determine the calibration value.

This calibration value may be used by the controller (130) during a printing procedure. During the printing procedure and for each sheet of print media (110), the edge of the print media (110) may be detected. The edge position data of the edge of the print media (110) for each sheet may be relayed to the controller (130) which augments the value with the calibration value to calculate an adjustment value associated each sheet of print media (110). With the adjustment value, the controller (130) may send data to the servomechanism (165) which causes the media transport mechanism (120) to place each sheet of print media (110) against the registration wall based on the adjustment value.

In an example, the media support members (145) may also be directed by the controller (130) to move in a direction non-parallel to the media feed path in order to adjust the position of the registration wall. Any combination of movement by the media transport mechanism (120) via the servomechanism (165) and the media support members (145) may allow the sheet of print media (110) to be placed on the media support members (145) in the media accumulation system (140) against the registration wall.

Figure 2:
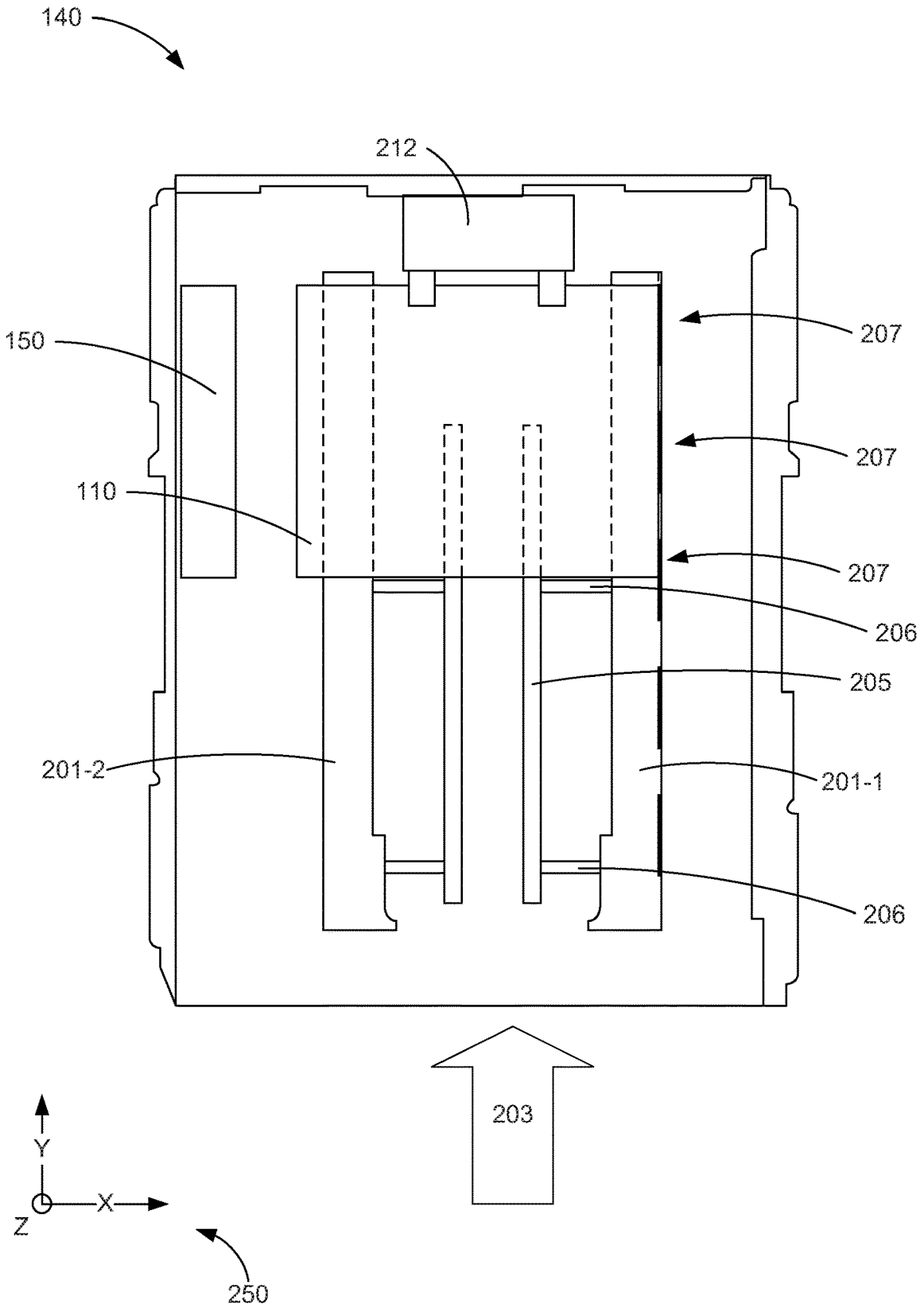
FIG. 2 is a top view of a media accumulation system of the printing device of FIG. 1B according to an example of the principles described herein.

FIG. 2 is a top view of a media accumulation system (140) of the printing device (100) of FIG. 1 according to an example of the principles described herein. As an indication of reference, a three-dimensional Cartesian coordinate indicator (250) is shown in FIG. 2. Throughout the drawings, the three-dimensional Cartesian coordinate indicator is provided to orient the reader as to directions of movement and forces placed on the elements of the mezzanine support member (201). Throughout the figures, a circle located at the origin of the coordinate indicator indicates that the positive direction is moving or corning out of the page toward the reader. Conversely, a square indicates that the negative direction is moving or coming out of the page toward the reader.

As mentioned above, the media accumulation system (140) may include a plurality of media support members (201-1, 201-2). In the example shown in FIG. 2, the number of media support members (201-1, 201-2) is two. Although FIG. 2 shows two media support members, any plurality of media support members (201-1, 201-2) greater than two may be used and the present specification contemplates the use of any number of media support members (201) exceeding two. In FIG. 2, the print media (110) is received into the media accumulation system (140) from the bottom of the figure as indicated by a print media path arrow (203). The media transport mechanism (FIG. 1, 120) may advance the print media (110) onto the media support members (201). In an example, the media transport mechanism (FIG. 1, 120) may include, among other devices, a series of clamps and pulleys to receive the print media (110) from the output of the printing device (FIG. 1, 100) and place it onto the plurality of media support members (201-1, 201-2).

Each of the media support members (201-1, 201-2) includes a number of articulating extension bars (205) and a number of extension arms (206). The extension arms (306) and articulating extension bars (205) may provide additional support to print media (110) as it accumulates on the mezzanine support members (201-1, 201-2). In an example, articulation of the extension bars (205) out from the media support members (201) may be accomplished through movement of the media support members (201) via a number of gears. In another example, articulation of the extension bars (205) out from the media support members (201-1, 201-2) may be accomplished through use of an independently driven motor. The extension bars (205) may help support the print media (110) on the mezzanine level along with the media support members (201-1, 201-2). This may prevent the print media (110) from sagging between the media support members (201-1, 201-2) as the print media (110) is accumulated on the media support members (201-1, 201-2). Additionally, preventing sagging of the print media (110) may also prevent a permanent or semi-permanent deformation of the print media as the print media (110) is being accumulated on the media support members (201-1, 201-2). The controller (FIG. 1, 130) may direct the articulation of the extension bars (205) out from the media support members (201-1, 201-2) based on, for example, the orientation, size, and type of print media (110) being used for a print job. In certain examples, the extension bars (205) may not be used because of the type and/or size of the print media.

At least one of the media support members (201-1, 201-2), for example a front support member (201-1) may include a number of x-registration members (207). The x-registration members (207) may be a surface against which each of the sheets of print media (110) lie alongside when accumulated on the media support members (201-1, 201-2). This causes each of the sheets of print media (110)

to be registered in the x-direction as indicated by the three-dimensional Cartesian coordinate indicator (250). When the media support members (201-1, 201-2) move non-parallel to the print media path (arrow 203) in order to engage an accumulated stack of print media (110) towards a finishing device (150), the x-registration members (207) prevent the accumulated stack of print media (110) from misaligning in the x-direction relative to each other.

The media accumulation system (140) may further include a number of y-registration members. In one example, the y-registration members may be coupled to each of media support members (201-1, 201-2) and may move with the movement of the media support members (201-1, 201-2). In another example, the y-registration members may be coupled to another part of the media accumulation system (140) separate from the media support members (201-1, 201-2). Similar to the x-registration members (207), the y-registration members may be a surface against which each of the sheets of print media (110) lie alongside when accumulated on the media support members (201-1, 201-2). This causes each of the sheets of print media (110) to be registered in the y-direction as indicated by the three-dimensional Cartesian coordinate indicator (250). When the media support members (201-1, 201-2) move non-parallel to the print media path (arrow 203) in order to engage an accumulated stack of print media (110) towards a finishing device (150), the y-registration members prevent the accumulated stack of print media (110) from misaligning in the y-direction relative to each other.

Figure 3:
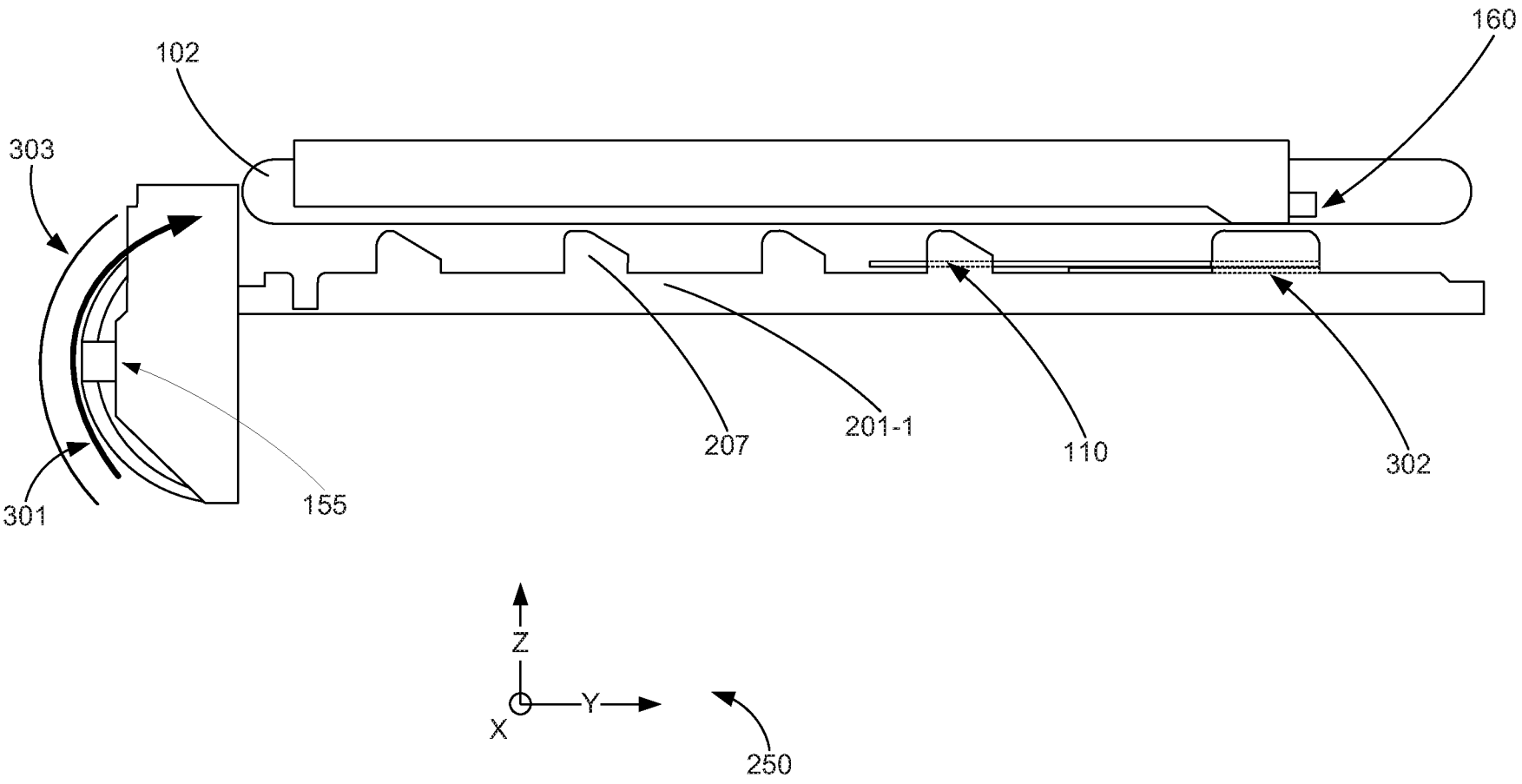
FIG. 3 is a side cutout view of an interface between the printing device and the output tray according to an example of the principles described herein.

FIG. 3 is a side cutout view of an interface between the printing device (FIG. 1, 100) and the media accumulation system (FIG. 2, 140) according to an example of the principles described herein. In an example, the media edge sensor (155) is placed along a media feed path (301) within the printing device (FIG. 1, 100). Although, the present specification describes the media edge sensor (155) being placed within the printing device (FIG. 1, 100), the media edge sensor (155) may be placed anywhere along a media feed path including within the media accumulation system (FIG. 2, 140). In an example, the media edge sensor (155) is placed upstream of the calibration sensor (160) within the media feed path.

Figure 6:
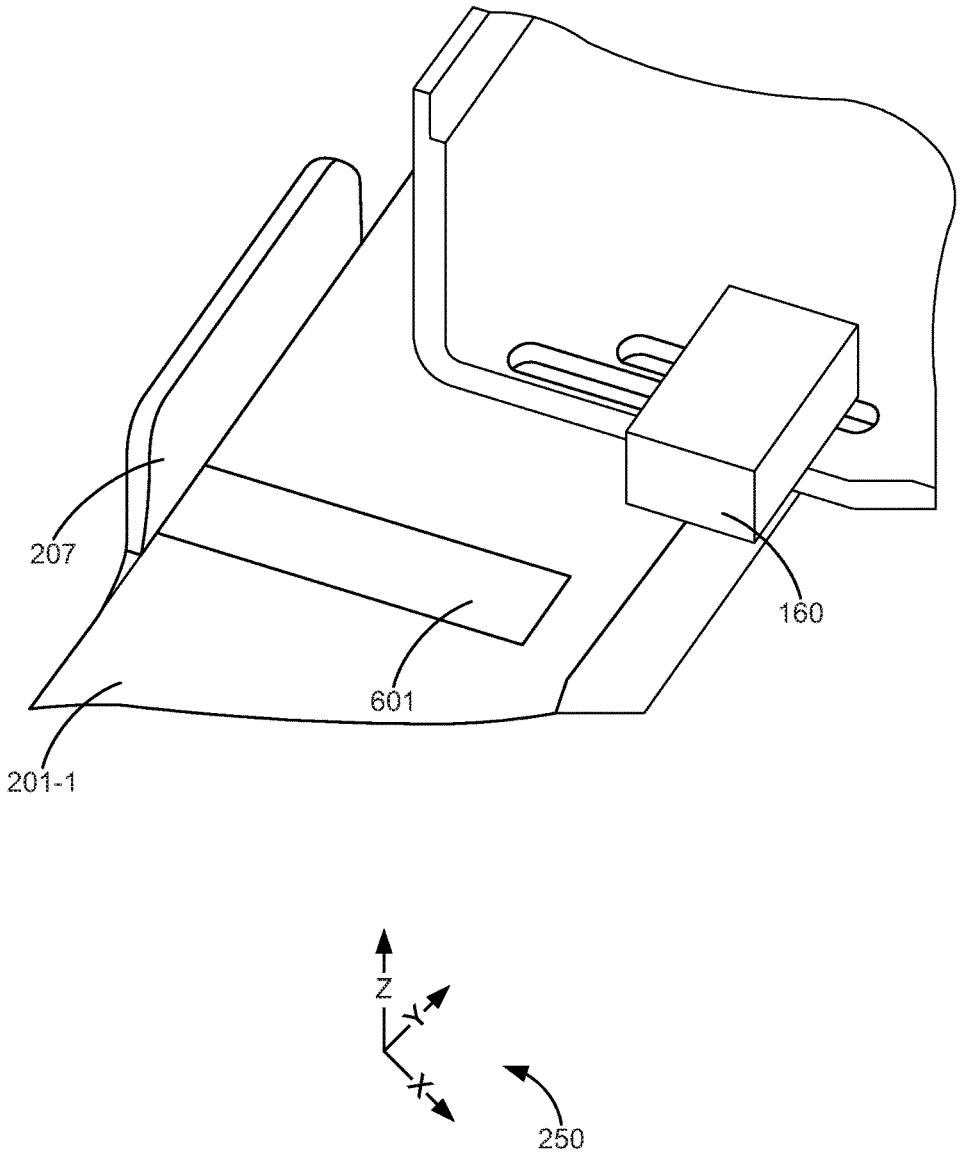

As shown in FIG. 3, the media accumulation system (FIG. 2, 140) may include a calibration sensor (160). The calibration sensor (160) detects an edge of a sheet of print media (110) as the print media (110) is placed on the media support members (201-1, 201-2). In an example, the calibration sensor (160) may include a reflective sensor that emits a light onto a mirrored surface (FIG. 3, 302; FIG. 6, 601) of the front media support member (201-1). Light reflected back to the calibration sensor (160) indicates that no print media (110) has been placed on the media support members (201-1, 201-2). When a sheet of print media (110) is passed under the calibration sensor (160), no light is allowed to reflect back to the calibration sensor (160) and the position of the detection of the print media (110) is relayed back to the controller (FIG. 1, 130). This provides an indication to the controller (FIG. 1, 130) how far the servomechanism (FIG. 1, 165) had traveled before the calibration sensor (160) detected the edge of the print media (110). As will be discussed in more detail below, the calibration sensor (160) detects the edge of the print media (110) that is to be aligned and registered with the x-registration members (207).

In an example, the front media support member (201-1) may include the number of x-registration members (207). As described above, the x-registration members (207) provide a wall against which a number of sheets of print media (110) may abut and be registered with. Along with the edge of the print media (110), the calibration sensor (160) may also be positioned to detect the x-registration members (207). This may be accomplished by placing a reflective or mirrored surface (302) on the front media support member (201-1) against the x-registration members (207). The calibration sensor (160) may be placed immediately above the mirrored surface (302) in the z-direction as indicated by the three-dimensional Cartesian coordinate indicator (250) on FIG. 3.

Figure 4:
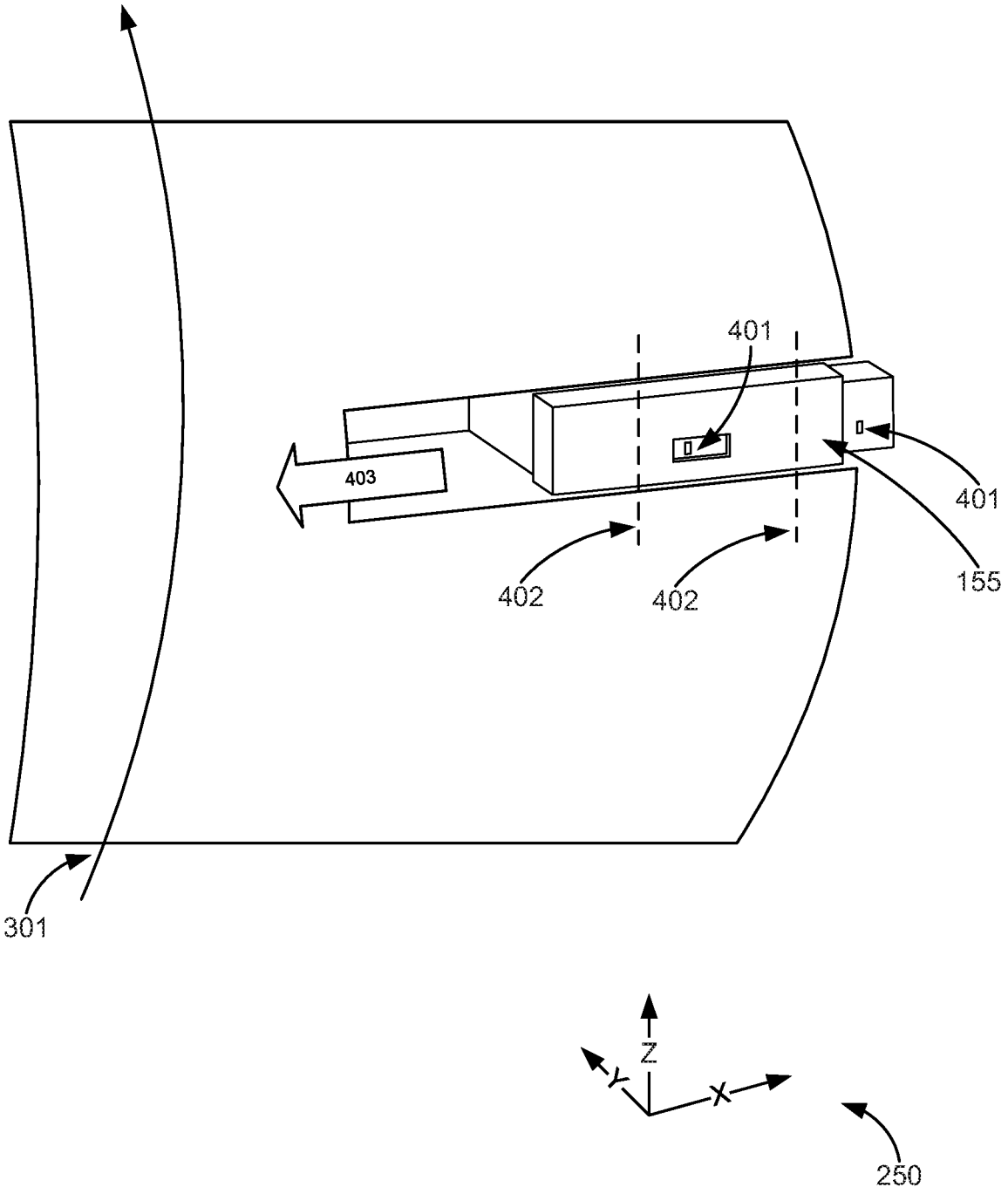
FIG. 4 is a perspective view of the media edge sensor positioned along a media feed path according to an example of the principles described herein.

Additional detail of an implementation of the media edge sensor (155) is shown in FIG. 4. FIG. 4 is a perspective view of the media edge sensor (155) positioned along a media feed path according to an example of the principles described herein. The media edge sensor (155) may comprise a number of, for example, reflective sensors (401) that each emit a light onto a mirrored surface on an opposite surface along the media feed path and detects reflected light from that surface. In the example shown in FIG. 4, the media edge sensor (155) includes two light reflective sensors. Any number of light reflective sensors may be used with the media edge sensor (155) and the present specification contemplates the use of any number of reflective sensors (401).

The media edge sensor (155) may move in a direction (403) non-parallel to the media feed path (301). The movement of the media edge sensor (155) non-parallel with reference to the media feed path (301) allows one of the reflective sensors (401) to detect a position of the edge (402) of a sheet of print media (110) passing along the media feed path (301). The position of the edge (402) may defined as an x-coordinate value as indicated by the three-dimensional Cartesian coordinate indicator (250). This data is sent to the controller (FIG. 1, 130) as indicated above in order for the controller (FIG. 1, 130) to identify a position value to correct the alignment of the sheet of print media (110) against the x-registration members (FIG. 3, 207). In one example, the translation time of the media edge sensor (FIG. 5, 155) for finding an edge could also be reduced by propositioning the media edge sensor (FIG. 5, 155) based on the "Zero Column" position otherwise obtained by the controller (FIG. 1, 130).

Figure 5:
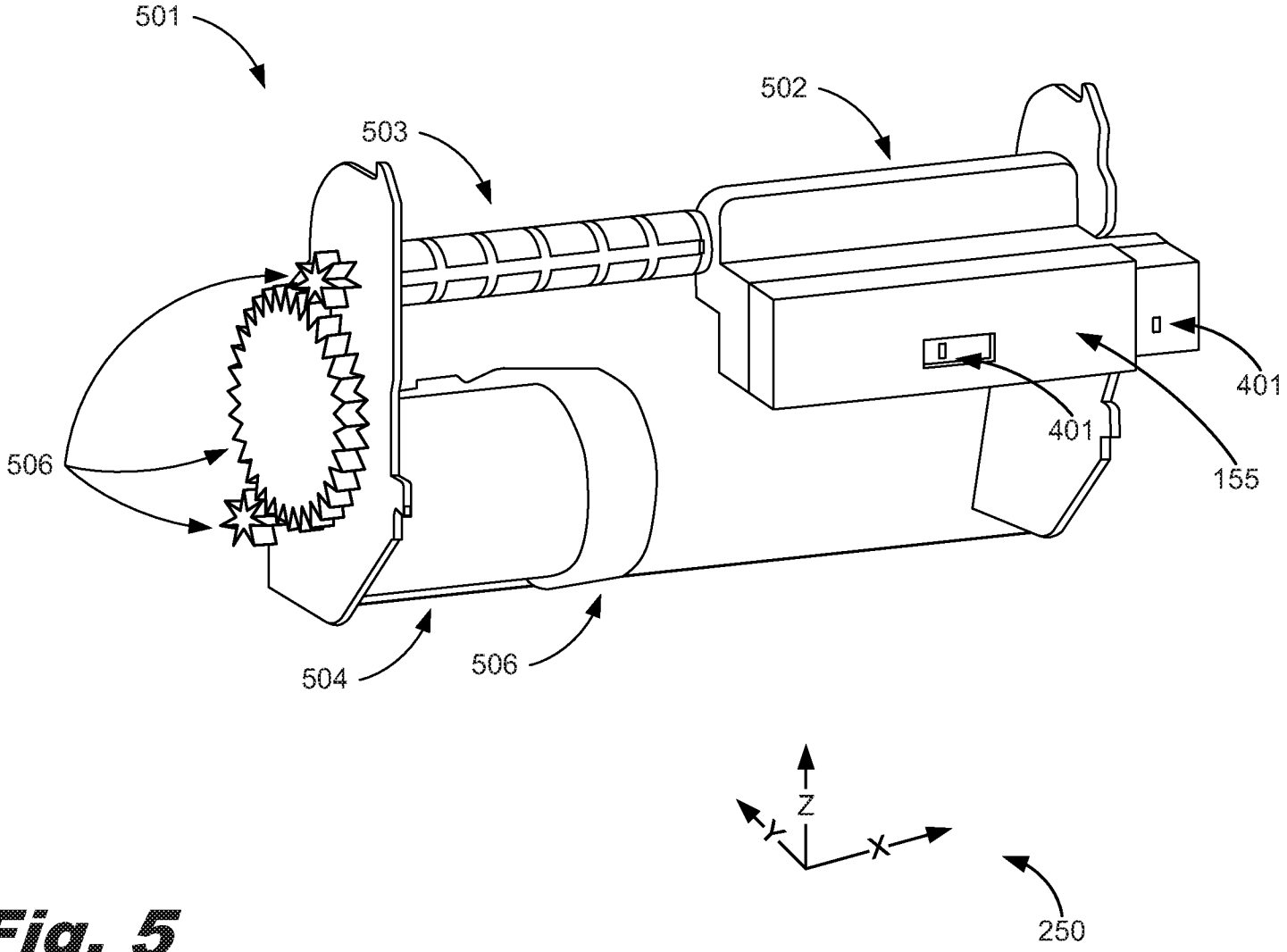
FIG. 5 is a perspective view of a translator for a media edge sensor according to one example of the principles described herein.

In an example, movement of the media edge sensor (155) may be accomplished using a motor and lead screw as seen in FIG. 5. FIG. 5 is a perspective view of a translator (501) for a media edge sensor (155) according to one example of the principles described herein. The translator (501) may comprise a carriage (502) coupled to the media edge sensor (155), a lead screw (503) engaging the carriage (502), and a motor (504) driving, via a number of gears (505), the lead screw (503). Along with the motor (504), the translator (501) may further include an encoder (506). These will now be descried in more detail.

The carriage (502) may be coupled to the media edge sensor (155) in order to support and prevent the media edge sensor (155) from moving. Because and encoder (506) is used to convert an angular position or motion of an axle of, for example, the motor (504), the carriage (502) is to maintain the media edge sensor (155) in position relative to each other. The carriage (502) may include a threaded interface to accept the treads of the lead screw (503). The interface of the lead screw (503) and the carriage (502) provides that rotation motion of the lead screw (503) causes the carriage (502) and the coupled media edge sensor (155) to be moved non-parallelly to the direction of the media feed path (FIG. 4, 301).

The lead screw (503) may be rotationally driven using a number of gears (505) being rotated by the motor (504). FIG. 5 shows a gear (505) coupled to the lead screw (503), a gear (505) coupled to an axle of the motor (504), and an intermediary gear converting rotational movement of the gear (505) associated with the motor (504) into rotational movement of the gear (505) associated with the lead screw (503). Although FIG. 5 shows the use of these three gears, any number of combination of gears (505) may be used to convert rotational movement of the axle of the motor (504) into rotational movement of the lead screw (503). The actuation of the motor (504) is controlled by the controller (FIG. 1, 130) as described above in order to move the media edge sensor (155) while a sheet of print media (110) passes along the media feed path (FIG. 4, 301).

The encoder (506) may monitor the rotational movement of, for example, an axle of the motor (504) to determine the position of the media edge sensor (155). As described above, rotational movement of the axle of the motor (504) results in lateral movement of the media edge sensor (155) in the x-direction indicated in the three-dimensional Cartesian coordinate indicator (250). The encoder (506) may be calibrated to determine the extreme positions of the media edge sensor (155) and calculate the position of the media edge sensor (155) at any given point in time.

As described above, any data related to the position of the edge (FIG. 4, 402) of the sheet of print media (110) is relayed to the controller (FIG. 1, 130). This edge position data is used by the controller (FIG. 1, 130) to calibrate the page registration system described herein as well as align sheets of print media (110) against the x-registration members (FIG. 3, 207) during a printing process.

FIG. 6 is a top perspective view of the calibration sensor (160) and front media support member (FIG. 3, 201-1) according to an example of the principles described herein. In one example, the calibration sensor (160) may be affixed above the front media support member (FIG. 3, 201) in the z-direction according to the three-dimensional Cartesian coordinate indicator (250). The placement of the calibration sensor (160) above the front media support member (FIG. 3, 201-1) allows the calibration sensor (160) to determine when a sheet of print media (110) passes between the calibration sensor (160) and a mirrored surface (601) on the front media support member (FIG. 3, 201-1). As described above, the servomechanism (FIG. 1, 165) may cause the media transport mechanism (FIG. 1, 120) to move in the x-direction according to the three-dimensional Cartesian coordinate indicator (250) until the calibration sensor (160) detects the edge. Again, the edge (FIG. 4, 402) to be detected by the calibration sensor (160) is the edge of the sheet of print media (110) that is to be registered against the x-registration members (207).

When the edge (FIG. 4, 402) has been detected, the position of the media transport mechanism (FIG. 1, 120) may be determined and the edge detection data from the calibration sensor (160) may be provided to the controller (FIG. 1, 130). The edge detection data may include an x-dimensional position of the edge (FIG. 4, 402) of the sheet of print media (110). Additionally, when the edge (FIG. 4, 402) has been detected, the distance data from the servomechanism (165) may also be sent to the controller (FIG. 1, 130) describing how far the media transport mechanism (FIG. 1, 120) had moved in order to register the sheet of print media (110) with the x-registration members (207).

During operation, a user may be prompted to conduct the calibration process as described above before a print job is started. In an example, the user may be prompted to provide a single sheet of print media (110) to the printing device (FIG. 1, 100). The printing device (FIG. 1, 100) may then pass the sheet of print media (110) through any number of mechanical devices within the printing device (FIG. 1, 100) with or without applying an image to the sheet of print media (110). As the sheet of print media (110) passes by the media edge sensor (FIG. 5, 155), the media edge sensor (FIG. 5, 155) obtains the x-directional position of the edge (FIG. 4, 402) of the sheet of print media (110). As the sheet of print media (110) progresses through to the media accumulation system (FIG. 2, 140), the media transport mechanism (FIG. 1, 120) pulls the sheet of print media (110) onto the media support members (FIG. 2, 201-1, 201-2). While the media transport mechanism (FIG. 1, 120) is pulling the sheet of print media (110) in a direction parallel with the media feed path (FIG. 4, 301), it also pulls the sheet of print media (110) in a direction non-parallel to the media feed path (FIG. 4, 301). When the calibration sensor (160) detects the edge (FIG. 4, 402) of the sheet of print media (110), all data from the calibration sensor (160), media transport mechanism (FIG. 1, 120) and servomechanism (FIG. 1, 165), and media edge sensor (FIG. 5, 155) is provided to the controller (FIG. 1, 130) for calibration purposes. As described above, the controller (FIG. 1, 130) may calculate a calibration value that is the distance the media transport mechanism (FIG. 1, 120) had to travel from the detected position data by the media edge sensor (155). After the calibration process has been conducted, a print job may be started and the calibration value may be used to cause the print media (FIG. 1, 110) to be registered against the x-registration members (207). In an example, this may be accomplished by using the calibration value to adjust the movement of the media transport mechanism (FIG. 1, 120) towards the x-registration members (207). In another example, this may be accomplished by using the calibration value to adjust both the movement of the media transport mechanism (FIG. 1, 120) and the media support members (FIG. 2, 201-1, 201-2) in order to register the edge (FIG. 4, 402) of any number of sheets of print media (110) with the x-registration members (207).

Figure 7:
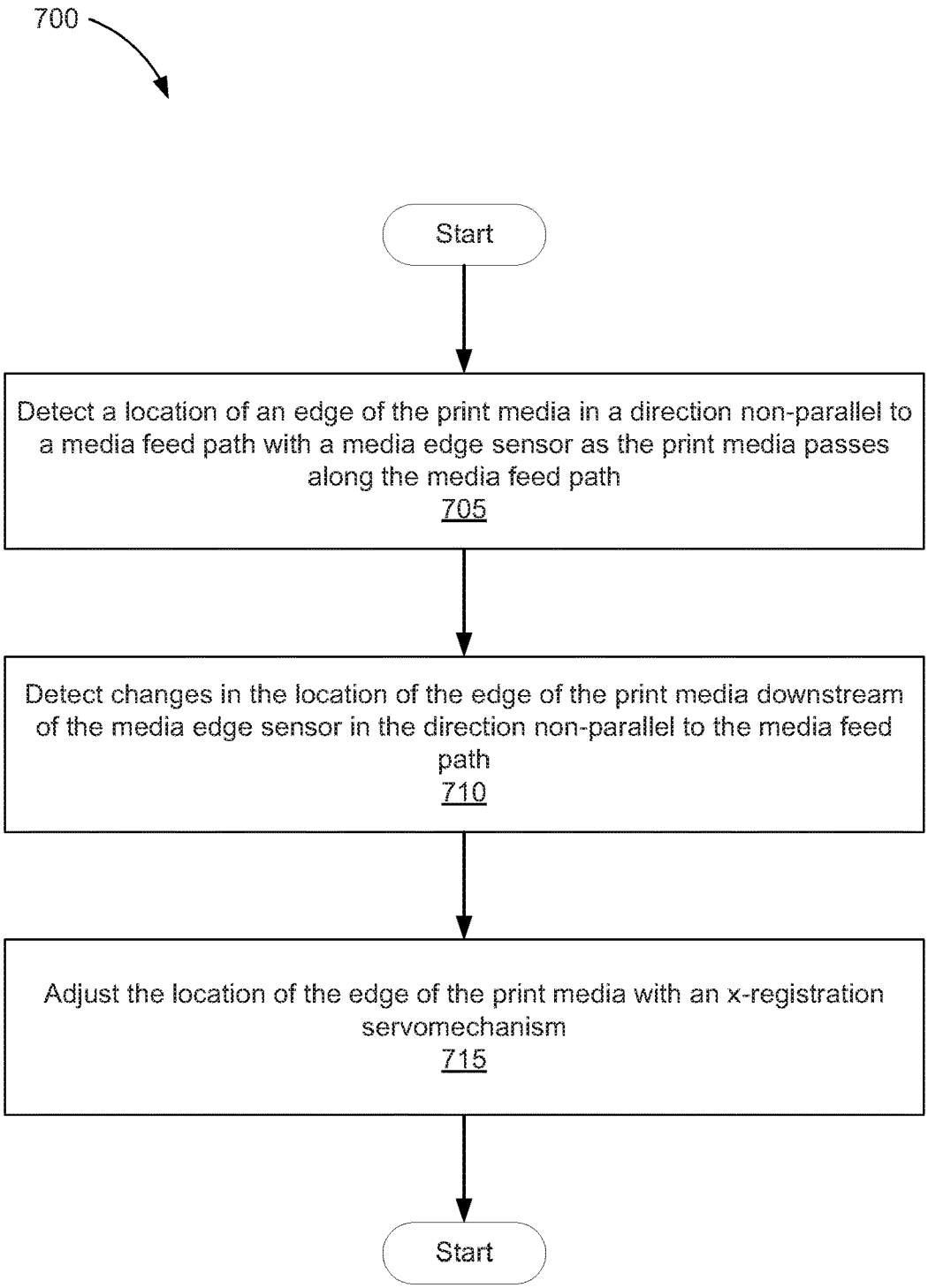
FIG. 7 is a flowchart describing a method for registering print media in a page registration system according to one example of the principles described herein.

FIG. 7 is a flowchart describing a method (700) of registering print media in a page registration system according to one example of the principles described herein. The method (700) may begin by detecting (705) a location of an edge (FIG. 4, 402) of the print media (110) in a direction non-parallel to the media feed path (FIG. 4, 301) with a media edge sensor (FIG. 5, 155) as the print media (110) passes along the media feed path (FIG. 4, 301). Detection of the edge (FIG. 4, 402) of the sheet of print media (110) results in edge position data being created and sent to the controller (FIG. 1, 130) as described above.

The method (700) may continue with detecting (710) changes in the location of the edge (FIG. 4, 402) of the print media (110) in the direction non-parallel to the media feed path (FIG. 4, 301) downstream of the media edge sensor (FIG. 5, 155). As described above, this is done using the calibration sensor (160), the media transport mechanism (FIG. 1, 120), and the servomechanism (FIG. 1, 165) working in concert to move the sheet of print media (110) in a direction non-parallel to the media feed path (FIG. 4, 301) until the calibration sensor (160) detects the edge (FIG. 4, 402).

The method (700) may continue with adjusting (715) the location of the edge (FIG. 4, 402) of the print media (110) with an x-registration servomechanism (FIG. 1, 165). As described above, the x-registration servomechanism (FIG. 1, 165) may direct the media transport mechanism (FIG. 1, 120), according to instructions received from the controller (FIG. 1, 130), to move the edge (FIG. 4, 402) of the print media (110) against the x-registration members (207).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, the controller (FIG. 1, 130), a special purpose computer, or other programmable data processing apparatus to produce a machine, such that the computer usable program code, when executed via, for example, the controller (FIG. 1, 130) or other programmable data processing apparatus, implement the functions or acts specified in the flowchart and/or block diagram block or blocks. In an example, the computer usable program code may be embodied within a computer readable storage medium; the computer readable storage medium being part of the computer program product. In an example, the computer readable storage medium is a non-transitory computer readable medium.

The present specification describes a page registration system in, for example, an inkjet printing device. The page registration system allows for measurements to be taken in a media feed path and improves robustness because the sheet of print media is constrained between guides and consequently not impacted by, for example, printing fluid induced curl. The system uses relatively inexpensive components and servo systems to control the registration of the sheet of print media (110). This may reduce the cost of each printing device (FIG. 1, 100). Additionally, using two sensors in the path may also minimize the pre-positioning time since the carriage travels half the distance of any given sheet of print media (110).

The inclusion of the calibration sensor (FIG. 6, 160) and mirror (FIG. 6, 601) above the x-registration members (207) allows the printing device (FIG. 1, 100) to self-calibrate and adapt to nominal page centerline variation across the population of print engines and paper input accessories. The adaptation minimizes the shift that each sheet of print media (FIG. 3, 110) experiences and further creates precision and accuracy in page handling among units. In an example, once the x-direction location of a sheet of print media (110) is measured in the media feed path (FIG. 4, 301), the x-registration members (207) are positioned a set distance from the edge (FIG. 4, 402). This minimizes the number of the alignment mechanisms resulting in more efficient use of the available space within the printing device (FIG. 1, 100) and media accumulation system (FIG. 2, 140).

The handling and alignment of the print media (110) as described herein also benefits from a second scan of each sheet of print media (110) which may determine a skew of the sheet of print media (110). This second scan modulates the registration move to compensate for variability in edge (FIG. 4, 402) detection based on the y-position along the sheet of print media (110) where the edge (FIG. 4, 402) is found.

The preceding description has been presented to illustrate and describe examples of the principles described. This description is not intended to be exhaustive or to limit these principles to any precise form disclosed. Many modifications and variations are possible in light of the above teaching.

What is claimed is:

1. A page registration system, comprising:

media support members to accumulate print media thereon;

a media edge sensor to detect a location of an edge of a print medium of the print media along a media feed path and in a direction non-parallel to the media feed path; and a calibration sensor downstream of the media edge sensor to:

detect the location of the edge of the print medium in the direction non-parallel to the media feed path at a registration position;

detect the position of a number of registration walls running parallel to the direction of the media feed path; and provide calibration data to the page registration system to correct changes in the location of the edge of the print medium in the direction non-parallel to the media feed path;

wherein the page registration system is to add the print medium to print media accumulated on the media support members based on the calibration data.

2. The page registration system of claim 1, further comprising a servomechanism to receive the calibration data and adjust the location of the edge of the print medium according to the calibration data.

3. The page registration system of claim 2, wherein the servomechanism adjusts the location of the edge of the print medium by receiving the detected location of the edge of the print medium from the media edge sensor and, with the calibration data, is to position the edge of the print medium at a predetermined location.

4. The page registration system of claim 1, wherein the media edge sensor comprises a number of optical sensors to detect the edge of the print medium.

5. The page registration system of claim 1, further comprising a carriage coupled to the media edge sensor to translate the media edge sensor in the non-parallel direction while the media edge sensor detects the edge of the print medium.

6. The page registration system of claim 5, further comprising a motor and an encoder wherein the motor drives the carriage and the encoder determines the position of the media edge sensor.

7. The page registration system of claim 1, wherein one of the media support members comprises a number of x-registration walls against which the edge of the print medium is to be positioned.

8. The page registration system of claim 7, wherein the media support members are to move in a direction non-parallel to the media feed path to enable an accumulation of the print media thereon.

9. A method for registering print media in a page registration system, comprising:

detecting a location of an edge of the print media in a direction non-parallel to a media feed path with a media edge sensor as the print media passes along the media feed path;

detecting changes in the location of the edge of the print media downstream of the media edge sensor and in the direction non-parallel to the media feed path;

adjusting the location of the edge of the print media with an x-registration servomechanism adjusting the location of the edge of a subsequent sheet of print media by detecting a location of an edge of the subsequent sheet of print media with the media edge sensor and subtracting the calibration value; and accumulating the print media upon media support members based on the adjusting of the location of the edge of the print media.

10. The method of claim 9, further comprising computing the calibration value by comparing the detected location of the edge of the print media from the media edge sensor to the amount of location adjustment by the x-registration servomechanism.

11. The method of claim 10, further comprising adjusting the position of a number of x-registration walls against which the edge of the sheet of print media is to abut.

12. A media output system, comprising:

a plurality of media support members along a media feed path to receive a number of sheets of print media;

a page registration system comprising a calibration sensor to:

detect the position of an edge of at least one sheet of print media in a direction non-parallel to the media feed path; and detect the position of a number of registration walls running parallel to the direction of the media feed path; and a registration servomechanism to receive adjustment data from a controller to adjust the position of the edge of the at least one sheet of print media as the media is positioned at least one of the plurality of media support members.

13. The media output system of claim 12, wherein the page registration system further comprises a registration wall that the edge of at least one sheet of print media is registered.

14. The media output system of claim 12, wherein the page registration system receives data indicating the position of the edge of at least one sheet of print media in a direction non-parallel to the media feed path upstream of the calibration sensor and along a media feed path.

* * * * *